US005626239A

United States Patent [19]

Kobayashi

[11] Patent Number: 5,626,239

[45] Date of Patent: May 6, 1997

[54] SEPARATING MACHINE

[75] Inventor: Yoshikazu Kobayashi, Hiroshima, Japan

[73] Assignee: Kabushiki Kaisha Miike Tekkosho, Hiroshima, Japan

[21] Appl. No.: 486,728

[22] Filed: Jun. 7, 1995

Related U.S. Application Data

[62] Division of Ser. No. 259,468, Jun. 14, 1994, Pat. No. 5,480,034.

[30] Foreign Application Priority Data

| | | | |
|---|---|---|---|
| Jun. 22, 1993 | [JP] | Japan | 5-176001 |
| Dec. 1, 1993 | [JP] | Japan | 5-338816 |
| Dec. 27, 1993 | [JP] | Japan | 5-353235 |
| Feb. 7, 1994 | [JP] | Japan | 6-35368 |
| Mar. 18, 1994 | [JP] | Japan | 6-73987 |
| Mar. 18, 1994 | [JP] | Japan | 6-73988 |
| May 12, 1994 | [JP] | Japan | 6-124600 |

[51] Int. Cl.[6] ..... B07B 13/05

[52] U.S. Cl. ..... 209/667; 209/672

[58] Field of Search ..... 209/321, 659, 209/660, 667, 670, 671, 672

[56] References Cited

U.S. PATENT DOCUMENTS

| | | | |
|---|---|---|---|
| 1,418,899 | 6/1922 | Acken | 209/671 |
| 2,244,546 | 6/1941 | Stockdale | 209/671 |
| 2,966,267 | 12/1960 | Dunbar | 209/672 X |
| 3,353,947 | 11/1967 | Kramer | 209/321 X |
| 4,836,388 | 6/1989 | Bielagus | 209/677 X |
| 4,871,073 | 10/1989 | Berry et al. | 209/672 |

FOREIGN PATENT DOCUMENTS

| | | | |
|---|---|---|---|
| 1764712 | 9/1992 | U.S.S.R. | 209/672 |

*Primary Examiner*—William E. Terrell
*Assistant Examiner*—Tuan Nguyen
*Attorney, Agent, or Firm*—Koda and Androlia

[57] ABSTRACT

A screening machine comprising a plurality of rotors adapted such that in a frame the axes of the rotors are arranged parallel to one another from a supply side where objects to be screened including mixed substances different at least in size are supplied from above by a conveyor to a discharge side where the remainders after screening are discharged, and such that the rotors are rotated in the same direction by a rotating drive, each rotor further comprises at least two kinds of components, namely, a plurality of large diameter sections and a plurality of small diameter sections alternately disposed in the axial direction of each rotor and arranged in a staggered relation in the feeding direction to define screening gaps having desired dimensions between the large and small diameter sections.

12 Claims, 18 Drawing Sheets

SEPARATING MACHINE

This is a division of application Ser. No. 08/259,468, filed Jun. 14, 1994, U.S. Pat. No. 5,480,034.

BACKGROUND OF THE INVENTION

1. Field of the Invention

The present invention relates in general to a screening machine for screening objects of different sizes and more particularly to a screening machine for screening architectural wastes generated when buildings are pulled down, various mixed wastes including wastes from households and offices, and sticky wastes such as leftovers from restaurants, as well as compost, bark, wood chips from sawmills, soil, rubble, etc. depending on their sizes.

2. Prior Art

As a conventional waste screening machine of this kind, the applicant of the present invention has proposed a screening machine which feeds large objects over a plurality of rotary spiral members arranged parallel to one another in the rotation direction thereof, allows medium-sized and small objects to drop between the spiral members, then allows small objects to drop through a porous screen, and discharges medium-sized objects sideways by using the spiral members (Japanese Laid-open Patent Publication No. 4-176874). As shown in FIG. 18, this machine comprises a plurality of spiral members 013 arranged in a plane at a frame opening 012, the bottom of which is covered with a screen 011 for screening small waste objects W1 The spiral members rotate to convey large wastes W3 to the discharge side of the machine and allow small and medium-sized wastes W1 and W2 to drop through the gaps between the spiral members 013, 013, and also allow small wastes W1 through the screen 011, then discharge wastes W2 remaining on the screen 011 in the spiraling direction of the spiral member. This machine has been favorably accepted by architectural waste treatment contractors.

Various ropes, cords and tapes included in wastes to be screened may wind around the spiral members. To remove such ropes, etc. machine operation must be stopped occasionally. Furthermore, since damp or wet leftovers or compost included in wastes tends to clog the screen, it is apprehended that minute particles such as soil cannot be separated by screening.

SUMMARY OF THE INVENTION

The present invention is intended to solve the above-mentioned problems of the conventional technology. A primary object of the present invention is to provide a screening machine which is capable of screening wastes including a variety of substances ranging from architectural scraps to leftovers from restaurants and compost from farmhouses or the like abundantly and continuously into objects having at least two different sizes without clogging screening gaps, also capable of discharging lightweight ropes, cords and tapes in the rotation direction of rotors without causing winding around the rotors, further capable of screening damp and wet leftovers, compost and soil, ensuring negligible vibration and low noise operation, as well as easy installation and easy maintenance, and having a simple structure capable of screening large amounts of wastes continuously.

Another object of the present invention is to provide a screening machine capable of screening at least three kinds of objects depending on the size and weight: small objects, large lightweight objects and easy-to-roll and/or repulsive heavy objects.

A further object of the present invention is to provide a screening machine capable of increasing screening accuracy by separating attached substances and by separating piles, particularly by sufficiently scattering contents in bags and containers over rotors while objects to be screened are turned over and retained for a while in the middle of screening operation to sufficiently break them.

To attain the above-mentioned objects, an improved screening machine has been disclosed. The screening machine of the present invention is basically characterized by screening gaps defined between large diameter sections and small diameter sections alternately disposed on each rotor and arranged in a staggered relation with those on adjacent rotors. Accordingly, the screening gaps are always cleaned by the rotation of the large and small diameter sections, thereby preventing the screening gaps from being clogged. In addition, transfer airflow is generated over the rotors. Consequently, the screening machine can screen a variety of mixed wastes ranging from architectural scraps to leftovers from restaurants, as well as compost from farmhouses abundantly and continuously into two types of wastes different in size. Furthermore, the screening gaps defined between the rotors can be used to screen wet and damp soil, leftovers and compost without causing clogging. To prevent lightweight ropes, cords and tapes from winding around the rotors, they are lifted by airflow generated by the rotating rotors, and transferred and taken over sequentially by the large diameter sections. While being transferred by the rotors, waste lumps strike against the rotors sequentially and they are broken. Since only the rotors and a rotating drive means are moving components, machine vibration is negligible and noise is low. This simple structure ensures easy installation and maintenance.

More particularly, a screening machine of the present invention having a specific feature comprises a plurality of rotors adapted such that in a frame the axes of the rotors are arranged parallel to one another almost horizontally from a supply side where objects to be screened including mixed substances different at least in size are supplied from above by a conveying means to a discharge side where the remainders after screening are discharged, each rotor further comprises a plurality of large diameter sections and a plurality of small diameter sections alternately disposed in the axial direction thereof, and the large diameter sections and the small diameter sections of adjacent rotors are arranged in a staggered relation with one another in the feeding direction to define screening gaps between the large and small diameter sections. The rotors are rotated in the same direction. Each large diameter section of the rotor has a plurality of projections at least on one side, which do not interfere with the large and small diameter sections of adjacent rotors. Accordingly, in addition to the above-mentioned basic feature, the screening gaps can be made narrower by the projections disposed on the sides of the large diameter sections, thereby improving the screening accuracy of the machine and intensifying the transfer airflow.

Furthermore, a screening machine of the present invention having another specific feature comprises a plurality of rotors adapted such that in a frame the axes of the rotors are arranged parallel to one another from a supply side where objects to be screened including mixed substances different at least in size are supplied from above by a conveying means to a discharge side where the remainders after screening are discharged, the rotors being arranged in an inclined plane with the rotors on the discharge side being placed higher than those on the supply side, each rotor further comprises a plurality of large diameter sections and a plurality of small diameter sections alternately disposed in the axial direction thereof, and the large diameter sections and the small diameter sections of adjacent rotors are arranged in a staggered relation with one another in the feeding direction to define screening gaps between the large and small diameter sections. Each large diameter section of the rotor has a plurality of projections at least on one side, which do not interfere with the large and small diameter sections of adjacent rotors. Since this machine is provided with an additional capability of screening heavy objects remaining on the rotors without passing through the screening gaps by allowing such objects to roll down, the machine can screen wastes into at least three kinds of objects: easy-to-roll and/or repulsive heavy objects, relatively large lightweight objects, and small objects.

Furthermore, a screening machine of the present invention having still another specific feature comprises a plurality of rotors adapted such that in a frame the axes of the rotors are arranged parallel to one another, the arrangement having horizontal areas and at least one raised area, from a supply side where objects to be screened including mixed substances different at least in size are supplied from above by a conveying means to a discharge side where the remainders after screening are discharged, each rotor further comprises a plurality of large diameter sections and a plurality of small diameter sections alternately disposed in the axial direction thereof, and the large diameter sections and the small diameter sections of adjacent rotors are arranged in a staggered relation with one another in the feeding direction to define screening gaps between the large and small diameter sections. Each large diameter section of the rotor has a plurality of projections at least on one side, which do not interfere with the large and small diameter sections of adjacent rotors. Accordingly, objects to be screened on the rotors are turned over and struck by the large diameter sections. Because of this capability, the machine can break lumps, can break and scatter objects included in bags or containers while retaining such objects for some time and repeating turnover operations, and can separate attached substances and piles, thereby improving the screening accuracy.

Moreover, a screening machine of the present invention having a still further specific feature comprises a plurality of rotors adapted such that in a frame the axes of the rotors are arranged parallel to one another from a supply side where objects to be screened including mixed substances different at least in size are supplied from above by a conveying means to a discharge side where the remainders after screening are discharged, the rotors being arranged in an inclined plane with the rotors on the discharge side being placed higher than those on the supply side and having at least one raised area, each rotor further comprises a plurality of large diameter sections and a plurality of small diameter sections alternately disposed in the axial direction thereof, and the large diameter sections and the small diameter sections of adjacent rotors are arranged in staggered relation with one another in the feeding direction to define screening gaps between the large and small diameter sections. Each large diameter section of the rotor has a plurality of projection at least on one side, which do not interfere with the large and small diameter sections of adjacent rotors. Accordingly, objects to be screened on the rotors are retained and turned over repeatedly in the raised area to further break lumps and separate attached substances and piles. The machine can thus screen wastes into at least three different objects: easy-to-roll and/or repulsive heavy objects, relatively large lightweight objects, and small objects at high accuracy.

These and other objects, features and advantages of the present invention will be described below in BRIEF DESCRIPTION OF THE DRAWINGS and DETAILED DESCRIPTION OF PREFERRED EMBODIMENTS.

DETAILED DESCRIPTION OF PREFERRED EMBODIMENTS

Figure 1:
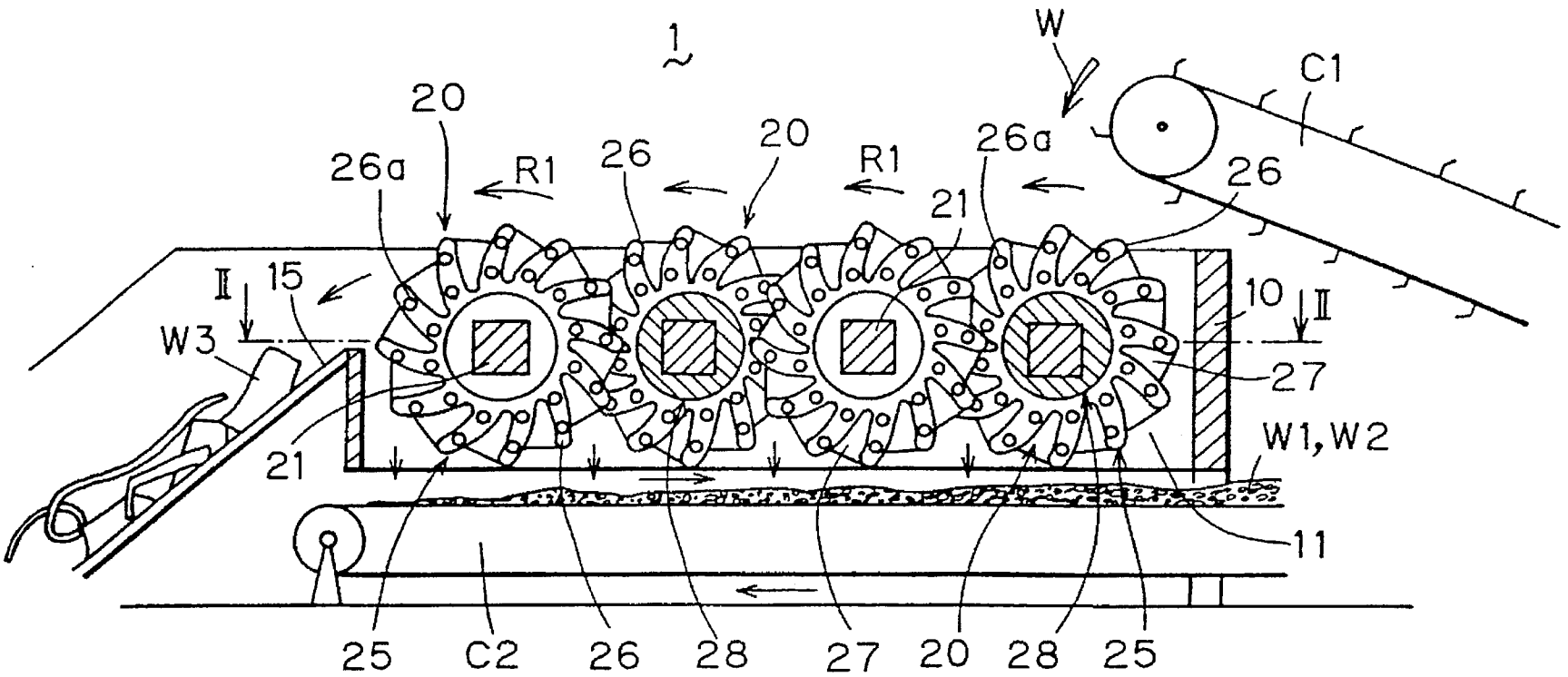
FIG. 1 is a vertical sectional view of a waste screening machine of a first embodiment of the present invention.

Referring to FIGS. 1 to 4, the waste screening machine 1 of the first embodiment of the present invention comprises a rectangular frame 10 installed above a belt conveyor C2 for carrying out small and medium-sized wastes W1, W2 screened and dropped through screening gaps G defined between rotors 20, four rotors 20, . . . arranged parallel to one another in a horizontal plane and journaled rotatably in the same direction (indicated by arrow R1) from the supply side of mixed wastes W to the discharge side of large wastes W3 remaining on the rotors 20, . . . after screening, a rotating drive means 30 for driving the rotors 20, . . . and a discharge section 15 for discharging large wastes W3 in the feeding direction.

Each rotor 20 comprises a drive shaft 21 having a square cross section with a gear secured at one end thereof, a boss 25*b* having a square hole 25*a* fitted onto the drive shaft 21, large diameter wheels 25 each extending from the periphery of the boss 25*b* in the radial direction and, in this example, composed of 12 finger-shaped protrusions bent backward in the rotation direction and equidistantly disposed on the periphery of the boss 25*b* in a rotational working plane around the boss 25*b*, and ring spacers 28 of small diameters interposed between the bosses 25*b* adjacent in the arrangement direction of the large diameter wheels 25 of each rotor 20 so as to retain the large diameter wheels 25 adjacent in the feeding direction in a staggered relation with one another and to define the screening gaps G having desired dimensions. The boss 25*b* and the finger-shaped protrusions 26 are integrated by using hard or soft plastics. The protrusion 26 has two hemispherical projections 26*a*, . . . on one side and has a flat surface on the other side. By changing the thickness of the spacer 28, the spaces between the projections 26*a*, . . . and adjacent protrusions 26 are changed. This results in changing the dimensions of the screening gaps G.

Figure 2:
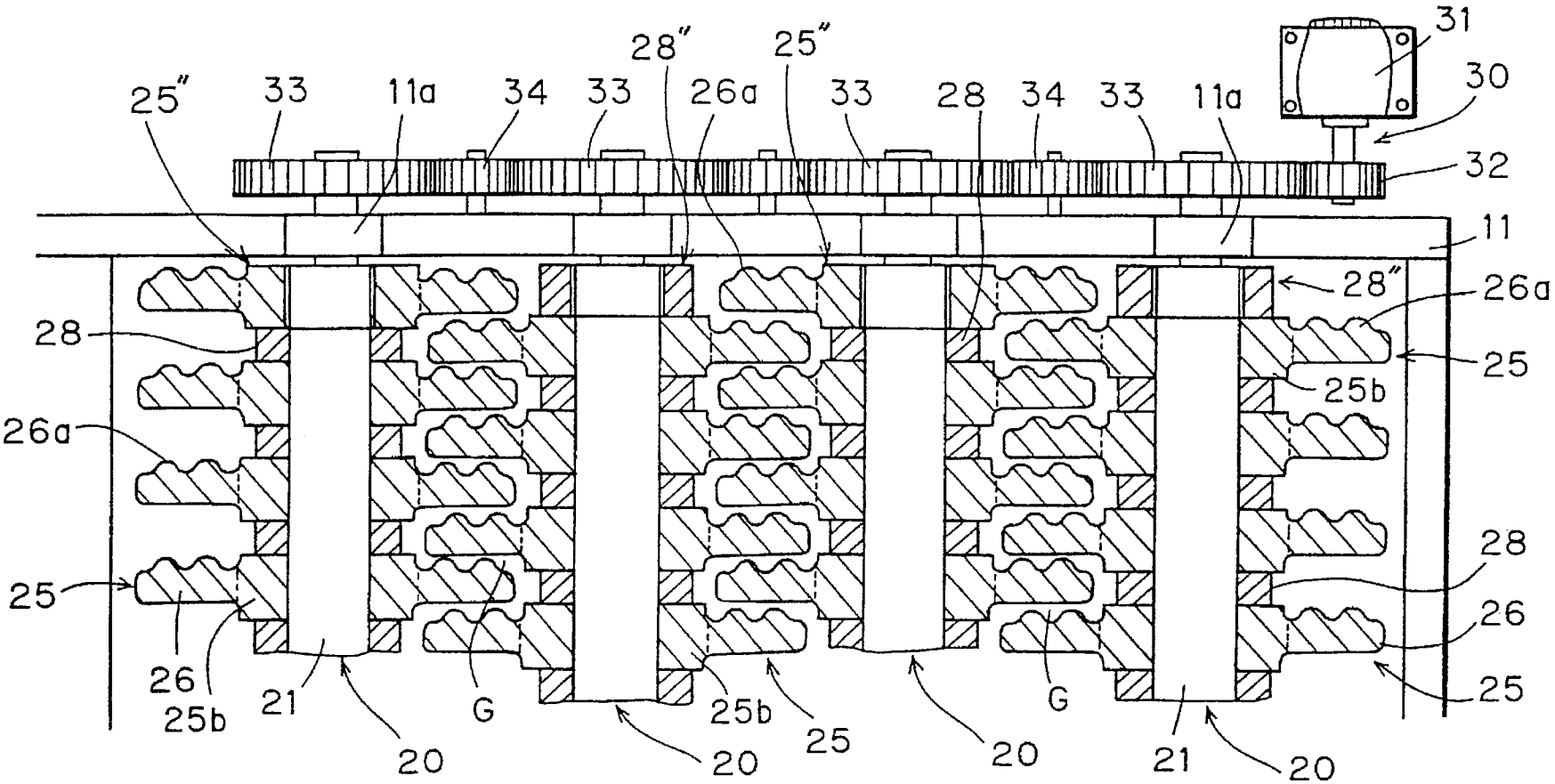
FIG. 2 is a partial horizontal sectional view taken on line II—II of FIG. 1.
Figure 3:
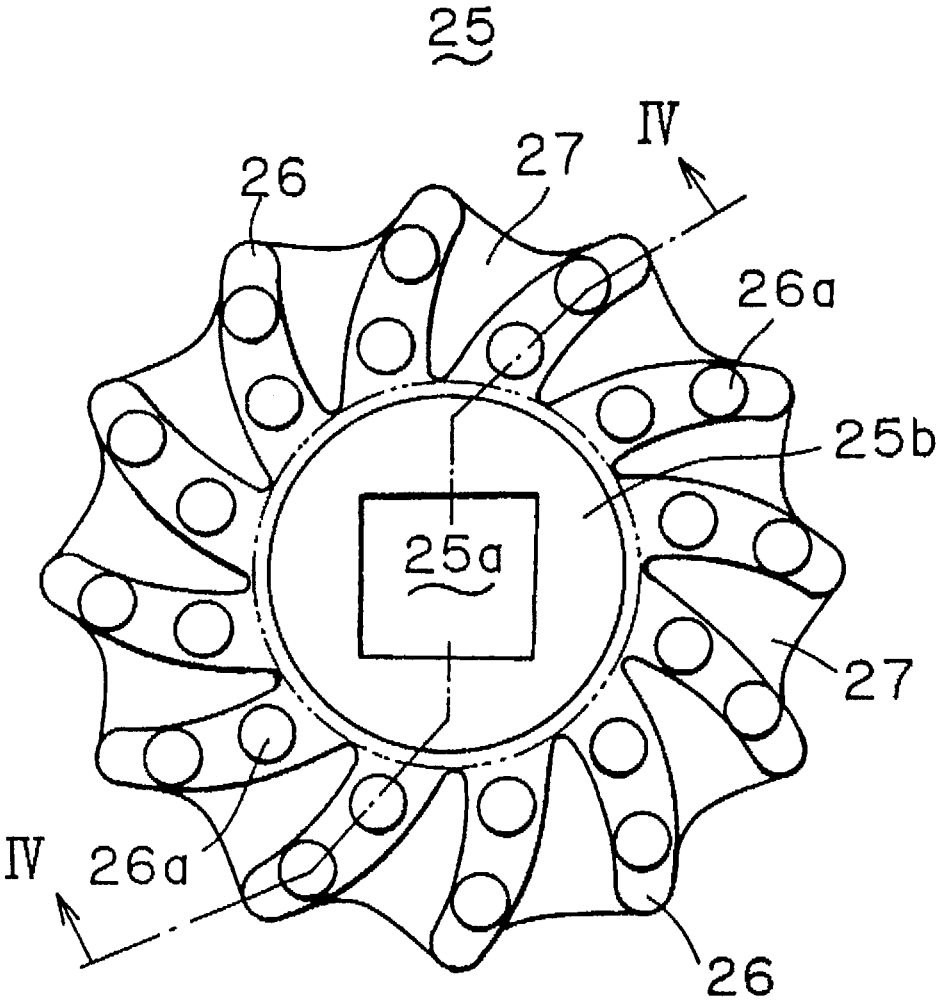
FIG. 3 is a Front view of a large diameter section of the rotor of the present invention.
Figure 4:
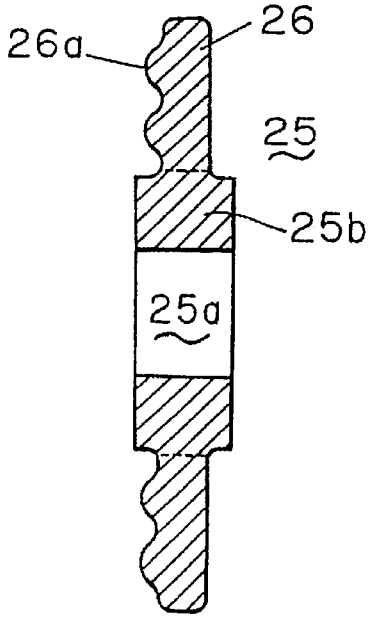
FIG. 4 is a sectional view taken on line IV—IV of FIG. 3.

Over the supply side of the frame 10, a conveyor C1 for supplying wastes such as architectural wastes is provided. On the discharge side, a ramp way 15 is connected to the frame 10 to discharge large wastes W3. Bearings 11*a* are disposed on both side walls 11 (only one side wall is shown in FIG. 2) to rotatably support the rotors 20. In addition, the rotating drive means 30 is disposed outside on one of the side walls 11. The rotating drive means 30 comprises a motor 31, a pinion gear 32 mounted on the output shaft of the motor 31, gears 33 engaged with the pinion gear 32 and connected to the rotors 20, and idler gears 34 disposed between the two gears 33 connected to the adjacent rotors 20. The rotating drive means 30 rotates a series of rotors (four rotors) 20, . . . in the direction indicated by arrow R1. The wheels 25, . . . and the ring spacers 28, . . . are secured to the square drive shaft 21 by threadedly engaging a ring nut 28" and a wheel 25", each having an internal thread, with external threads (not shown) formed at both ends of the circular portions of the shaft 21 and by tightening the ring nut 28" on one end and the wheel 25" on the other end, or by using bolts or the like individually.

The waste screening machine 1 of this embodiment can discharge lightweight objects such as radio cassette tapes, video cassette tapes, nylon cords, etc. together with large wastes W4 by generating airflow toward the discharge side during the operation of the rotors 20 and by floating such objects without causing winding around the rotors. The machine can also discharge slightly heavy ropes and wire bundles by sequentially taking over such objects using the finger-shaped protrusions 26 and the projections 28*a* thereon and by preventing such objects from winding around the protrusions 26 using connection webs 27. In addition, the machine can allow damp objects such as leftovers and sticky objects included in the wastes W to drop downward without causing clogging. By applying this capability, the machine can screen even compost. When the rotation speed of the rotors 20 is increased, the screening gaps G defined between the protrusions 26 having the projections 26*a* and the ring spacers 28 are narrowed relatively. When the rotation speed of the rotors 20 is decreased, the screening gaps G are widened relatively. Furthermore, the machine has an easy-to-maintain structure which hardly causes clogging and breakage. The machine generates negligible vibration and low noise, and can be installed easily. Moreover, the machine can continuously screen a large amount of architectural wastes, household garbage, office trash and restaurant leftovers into two types different in size. If wastes are broken before they are supplied to this screening machine 1, any treatment required after screening can be performed immediately.

Figure 5A:
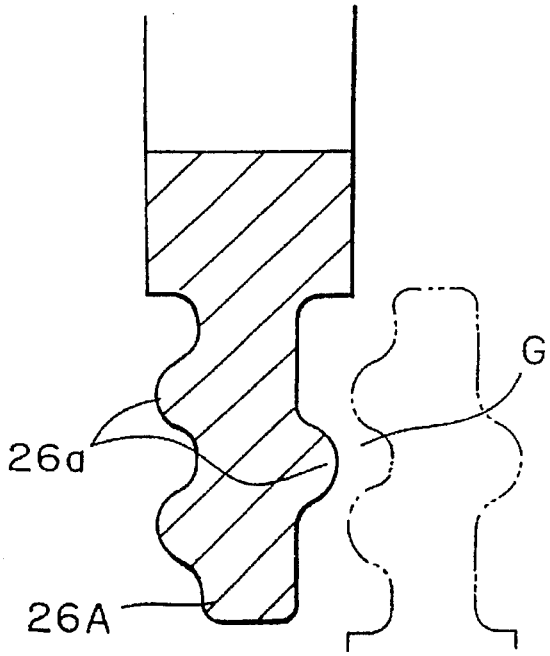
FIGS. 5(*a*) and 5(*b*) are views illustrating finger-shaped protrusions disposed on other examples of large diameter sections of the rotor.
Figure 5B:
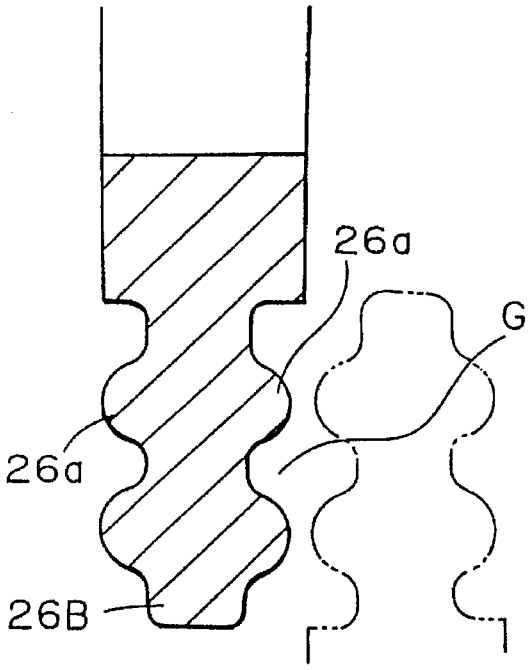

Other than the structure of the above-mentioned example of the rotors, the projections 26*a* can be formed such that they are arranged in a staggered relation as shown in FIG. 5(*a*) or in an opposed relation as shown in FIG. 5(*b*) on both sides of the protrusions 26A and 26B. Instead of the hemispheric projections, pyramid-shaped or conical projections may be formed. If wastes do not include ropes, cords or tapes, rotors having the large wheels 25 with no connection webs 27 may be used.

Figure 6:
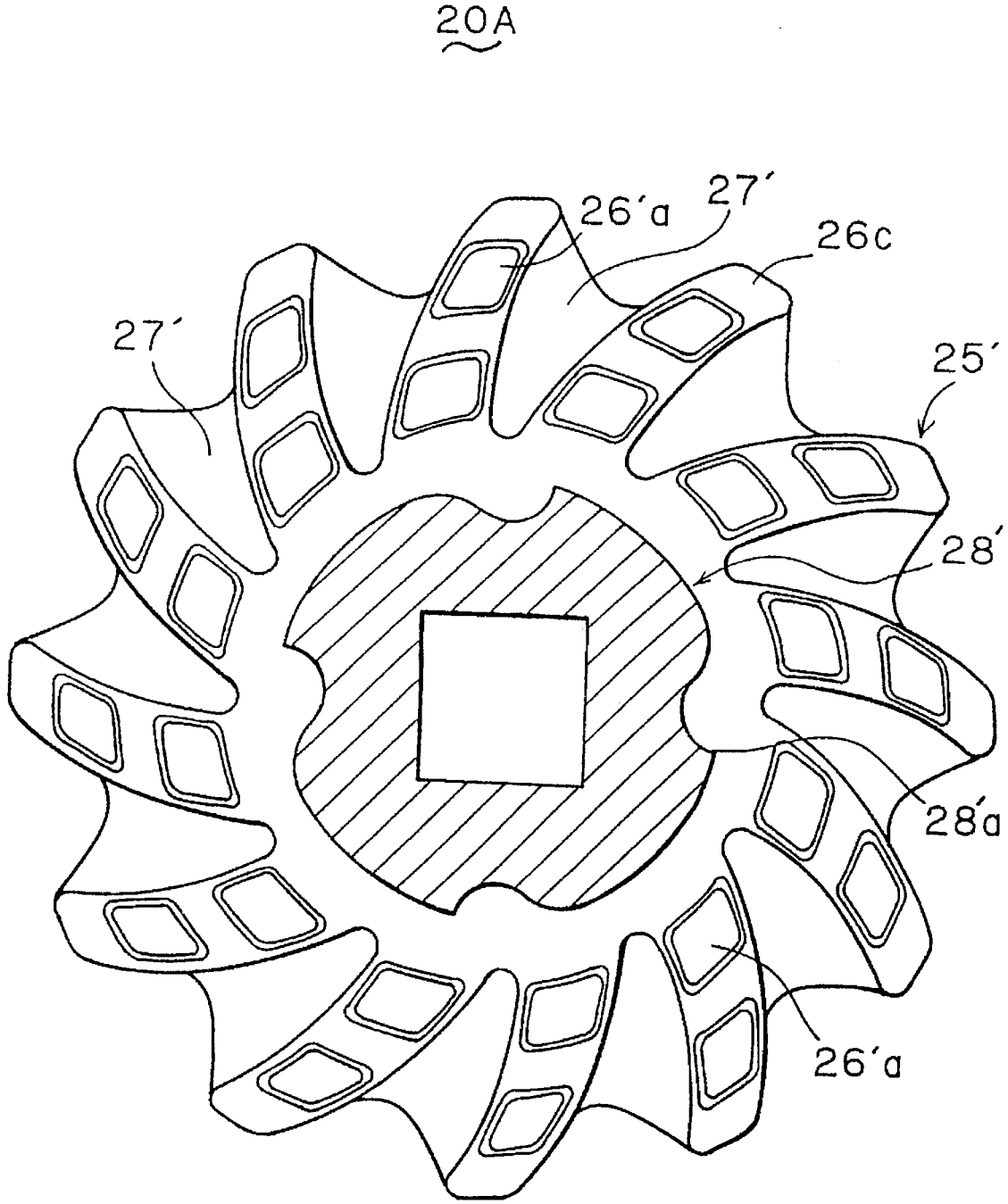
FIG. 6 is a front view of a large diameter wheel of another embodiment of the rotor.

Moreover, just as in the case of a rotor 20A shown in FIG. 6, a large diameter wheel 25' and a small diameter spacer 28' are integrated, and trapezoidal projections 26'*a* or conical projections can be formed such that they are arranged in a staggered relation or in an opposed relation on one or both sides of the protrusions 26C of the wheel 25'. The small diameter cylindrical section 28' has a plurality of projection stripes 28'*a* at equal intervals to generate airflow. The protrusions 26C are connected one another by the connection webs 27' on the periphery of the wheel 25' to prevent tapes From winding around the rotor during operation.

Figure 7:
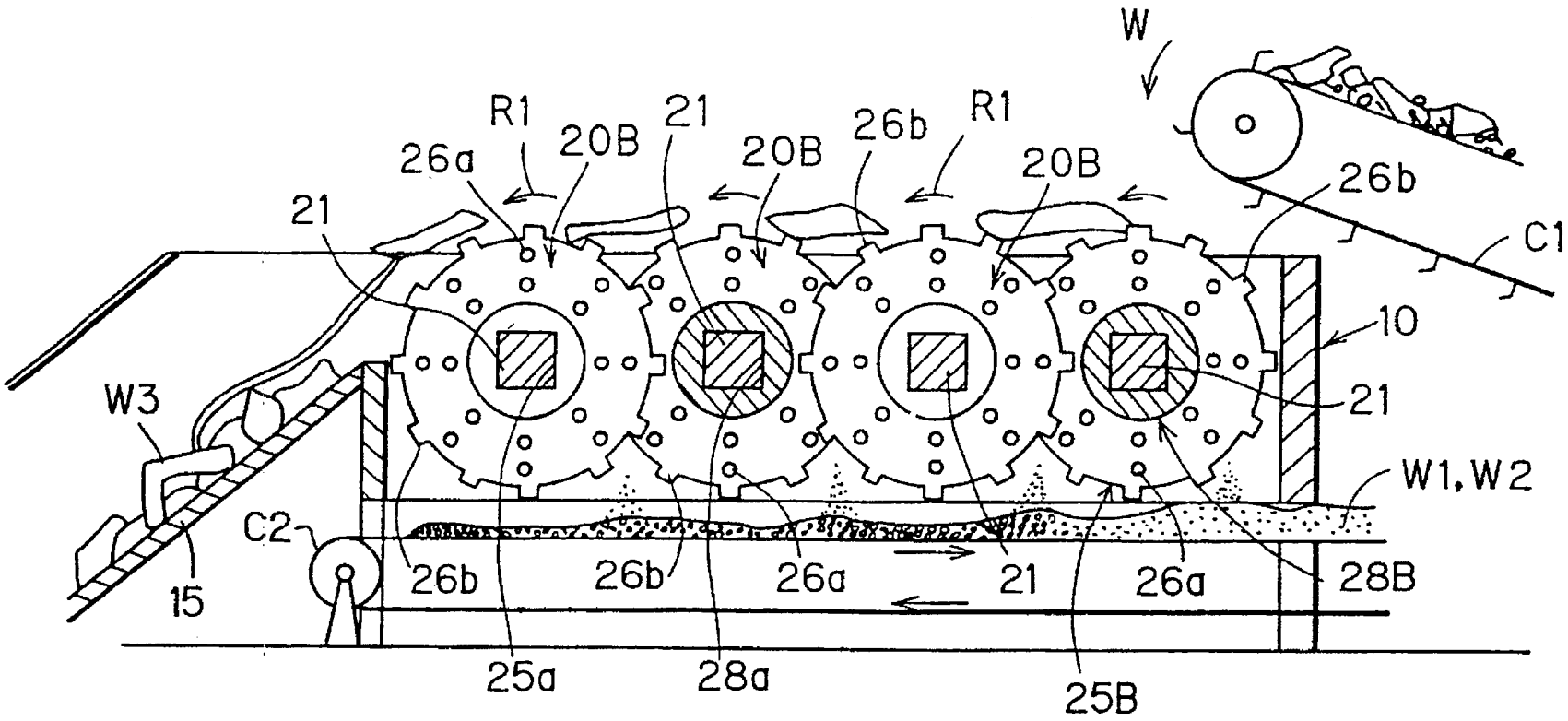
FIG. 7 is a view similar to FIG. 1, showing a screening machine which uses disc wheels for large diameter sections of the rotors.
Figure 8A:
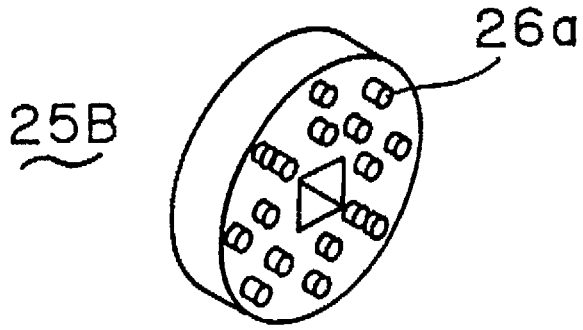
FIGS. 8(*a*) to 8(*d*) are perspective views showing other wheels used for the large diameter sections of the rotors.
Figure 8B:
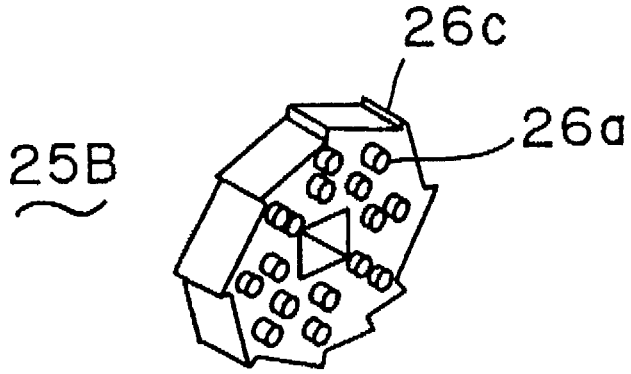
Figure 8C:
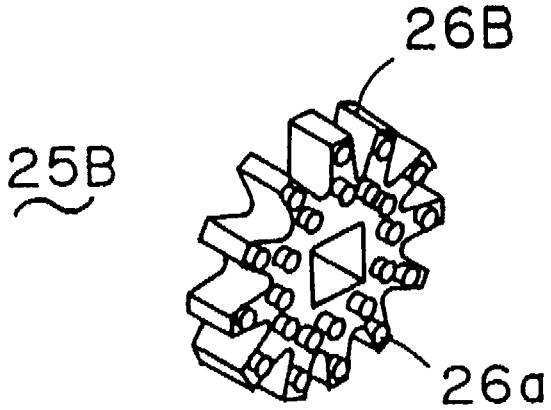
Figure 8D:
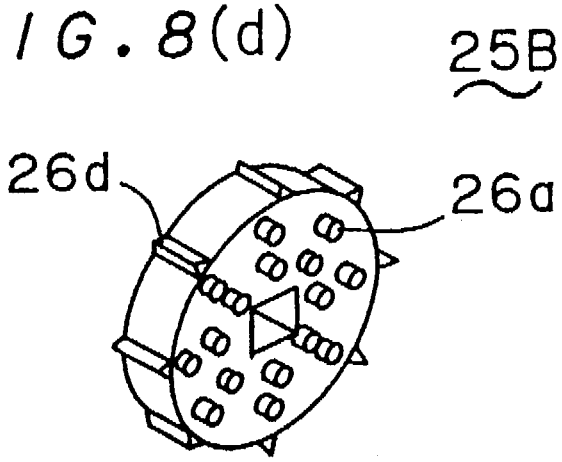

A still another rotor 20B shown in FIG. 7 comprises a square shaft 21 having a square cross section and connected to a gear secured thereto at one end, a plurality of large diameter wheels 25B made of hard rubber or soft plastics, provided with square holes 25*a* and 28*a* fitted onto the square shaft 21 and arranged in a staggered relation with adjacent large diameter wheels 25B, 25B in the feeding direction, and small diameter spacers 28B interposed between the large diameter wheels 25B, 25B. On one side of the wheel 25B, two hemispherical projections 26*a*, . . . disposed in the radial direction are disposed in eight rows in the peripheral direction, and the other side is made flat. When the thickness of the spacer 28B is changed, the space between the projections 26*a*, . . . and the wheel 25B adjacent to the projections is changed. This results in changing the dimensions of the screening gaps G. On the periphery of the Wheel 25B, projection stripes 26*b* are disposed at equal intervals to generate airflow. In addition, projection stripes can also be disposed on the periphery of the spacer 28B. The projections 26*a*, . . . have a function to distinguish the size of objects to be screened and a function to generate airflow so that this airflow and the airflow generated by the projection stripes 28*b* cooperatively serve to take over lightweight objects over the rotors 20B. The projections can have various shapes such as a cube, a truncated pyramid and a truncated cone. Furthermore, the square shaft 21 and the holes 2*a*, 28*a* fitted onto the shaft cannot be limited to have a square cross section, but can have a polygonal cross section.

Other than the shape shown in FIG. 7, the large diameter wheel 25B can have various shapes: a cylindrical shape shown in FIG. 8(*a*), a polygonal shape such as an octangle, shown in FIG. 8(*b*), having edges 26C to generate airflow, a shape, shown in FIG. 8(*c*), having a plurality of protrusions 26B (not used to screen wastes including ropes, cords and tapes), and a cylindrical shape, shown in FIG. 8(*d*), having projections 26*d* on the periphery thereof to vibrate wastes to be transferred. Circular projections 26*a* are disposed on one side or on both sides of the wheel 25B (the shape of the projections is not limited to a circular shape as a matter of course).

Figure 9:
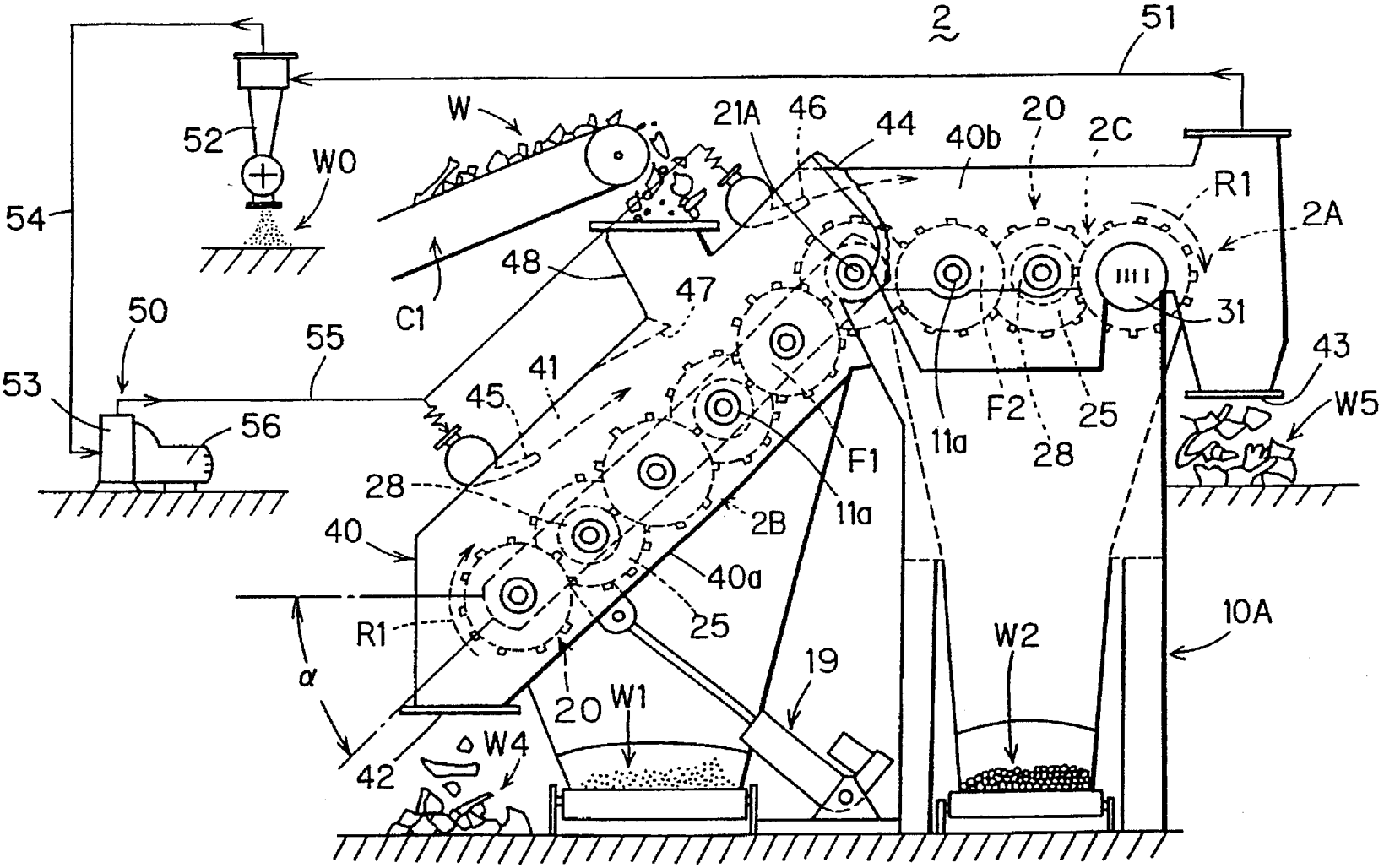
FIG. 9 is a front view of a waste screening machine of a second embodiment of the present invention.
Figure 10:
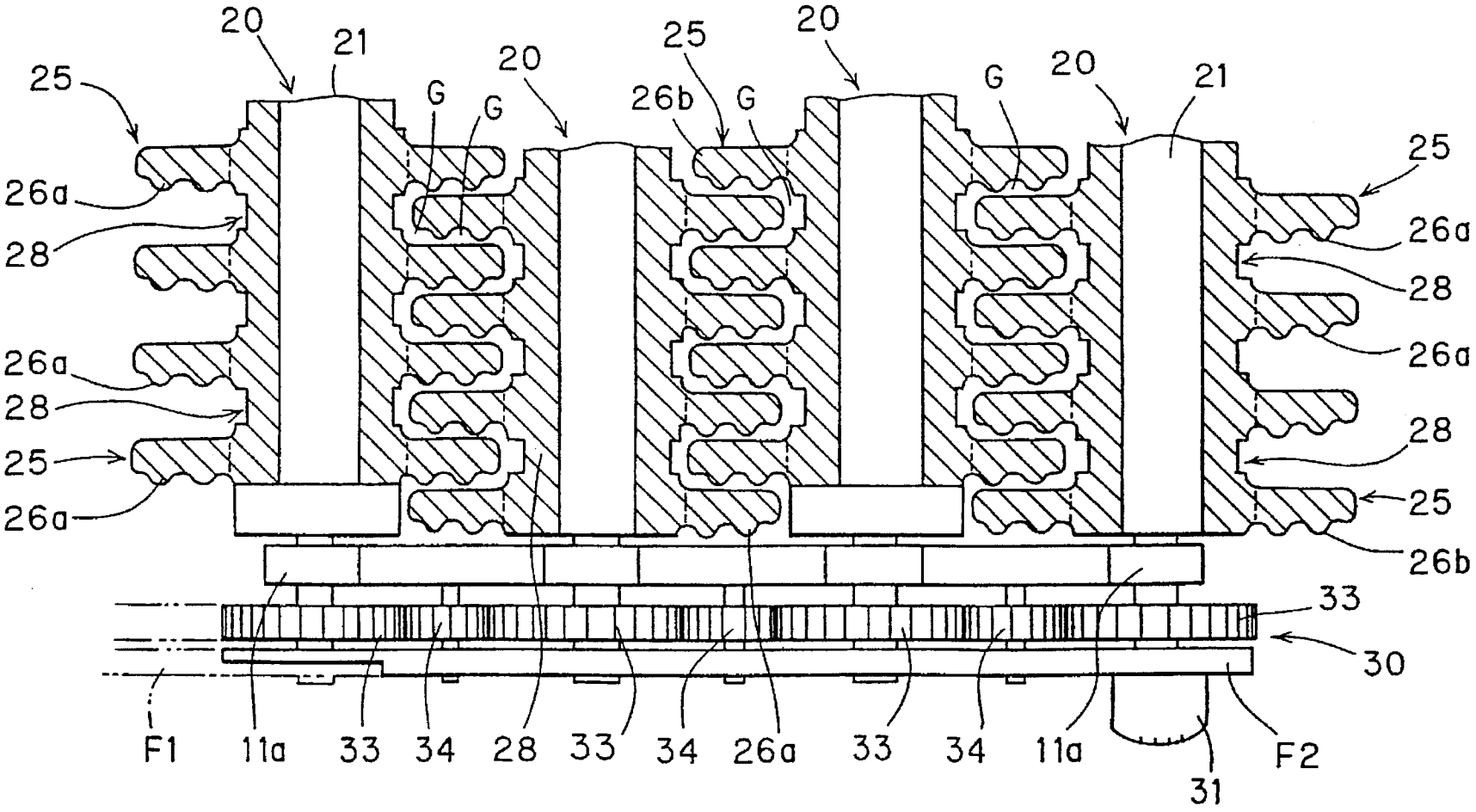
FIG. 10 is a partial plan view showing the arrangement of the rotors.

Referring to FIGS. 9 and 10, the waste screening machine 2 of the second embodiment of the present invention is used to screen wastes W including various wastes which have been broken roughly to appropriate sizes, supplied by a feed conveyor C1 and having differences in specific gravity and size into small wastes W1 such as soil, metal particles, etc., medium-sized wastes W2 such as wood pieces, plastic pieces, etc., wastes W4 such as easy-to-roll, repulsive, relatively heavy stones, bottles, pet bottles, cans, glassware and wood blocks, unrepulsive lightweight wastes W5 such as paper, film, sheets, cloth, corrugated cardboard, tapes, cords, etc. and dust W0. This machine comprises a rotor screening transferring means 2A composed of an inclined screening transferring block 2B and a horizontal screening transferring block 2C, a machine base 10A adjustably supporting the inclined screening transferring block 2B via an extensble/retractable means 19 in an adjusting range from a horizontal condition to about 60 degrees and also supporting the horizontal screening transferring block 2C at the top end section thereof, a housing 40 enclosing both side sections and the upper section of the rotor screening transferring means 2A and having a passage 41 over the screening transferring blocks 2B and 2C, a waste supply hopper 48 disposed at the upper middle section of the inclined section 40*a* of the housing 40 having a heavy object discharging opening 42 at the lower end thereof, a first air jet nozzle 45 disposed on the inclined section 40*a* of the housing 40 below the hopper 48 and a second air jet nozzle 46 disposed on the inclined section 40*a* of the housing 40 above the hopper 48, and an air pipe system 50 including a suction means 51 for sucking and separating minute particles so as to perform dust prevention. Below the hopper 48, a deflection plate 47 is disposed to prevent air directed from the first nozzle 45 from escaping through the hopper 48. The horizontal section 40*b* of the housing 40 having a lightweight waste discharging opening 43 is connected pivotally to the inclined section 40*a* of the housing 40 by rotor shaft end portions 21A. The connection and bending section between the inclined section 40*a* and the horizontal section 40*b* is sealed by a seal rubber 44.

The inclined screening transferring block 2B and the horizontal screening transferring block 2C have basically the same structure except for the number of the rotors 20 arranged. The two blocks are connected only by the rotor shaft end section 21A of the bending section. As shown in FIGS. 9 and 10, the two blocks comprise five and four rotors 20, . . . in rectangular frames F1 and F2 respectively, each group of the rotors being arranged parallel to one another in the same plane in the feeding direction and journaled rotatably in the same direction (indicated by arrow R1), and the rotating drive means 30 for driving the rotors 20, . . . Each rotor 20 has an integrated roll structure comprising a square shaft 21 having a square cross section and connected to a gear secured thereto at one end (both ends supported by the bearings 11*a* are circular), large diameter sections 25 having square holes fitted onto the square shaft 21, made of hard rubber or soft plastics and arranged in a staggered relation with adjacent large diameter sections in the feeding direction, and small diameter spacers 28 interposed between the large diameter sections 25, 25. The large diameter section 25 has hemispherical projections 26*a*, . . . on one side: two projections in the radial direction and eight rows of projections on the periphery. The other side of the large diameter section 25 is made flat. By changing the width of the small diameter sections which are used as spacers, the spaces between the projections 26*a*, . . . and the flat surfaces of the large diameter sections 25 adjacent to the projections are changed. This results in changing the dimensions of the screening gaps G. On the periphery of the large diameter section 25, projection stripes 26*b* are disposed at equal intervals to generate airflow. When a circular shaft is used instead of the square shaft 21 and keys are used to secure the large diameter sections 25, the small diameter sections may be omitted by using the exposed sections of the circular shaft in place of the small diameter sections.

The rotors 20 are supported by the bearings 11*a* between the side walls of the frames F1 and F2, and the rotating drive means 30 is disposed outside on one of the side walls. The rotating drive means 30 comprises a motor 31, a pinion gear 32 connected to the output shaft of the motor 31, rotor gears 33 and idler gears 34 disposed between the two gears 33, 33 connected to the adjacent rotors, and drives all the nine rotors 20 at the inclined and horizontal blocks in the direction indicated by arrow R1. The motor 31 is disposed at one end of the horizontal screening transferring block 2C. When the rotation speed of the rotors 20 is increased, the screening gaps G are narrowed relatively. As a result, the amount of small wastes W1 dropping from the inclined screening transferring block 2B decreases and the amount of medium-sized wastes W2 dropping from the horizontal screening transferring block 2C increases. At the same time, even slightly heavier objects are transferred upward, thereby increasing the amount of lightweight wastes W5. The small and medium-sized wastes W1 and W2 are transferred by a belt conveyor and can be used for reclamation. The lightweight wastes W5 and the heavy wastes W4 are further screened depending on the material thereof, and can be recycled or reused as solid fuel. The effect obtained by increasing the rotor speed is similar to that obtained by decreasing the inclination angle $\alpha$ of the inclined block 2B by using an extensible/retractable means 19 such as a hydraulic or electric cylinder or a jack. When the inclination angle $\alpha$ is increased, the amount of wastes dropping to the dropping area for the heavy wastes W4 increases, thereby shifting the sorting boundary point of the machine so that the amount of the lightweight wastes W5 increases. When the inclination angle is set to zero, that is, when the inclined block 2B is made horizontal, the screening effect of the rotors is the same as that obtained by the first embodiment.

Figure 11A:
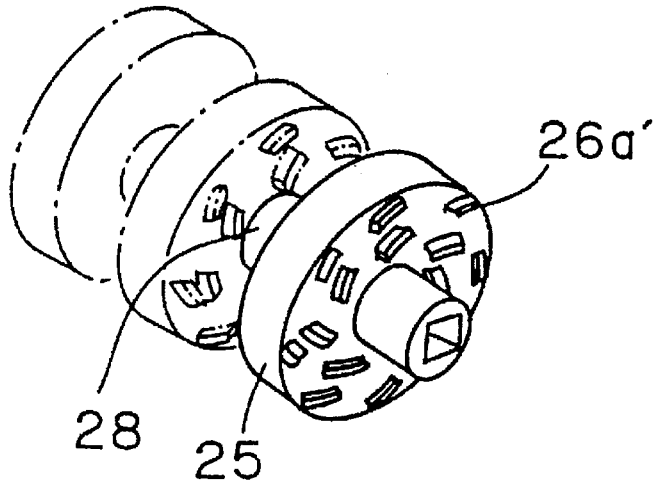
FIGS. 11(*a*) and 11(*b*) are partial perspective views showing other wheels used for the rotors.
Figure 11B:
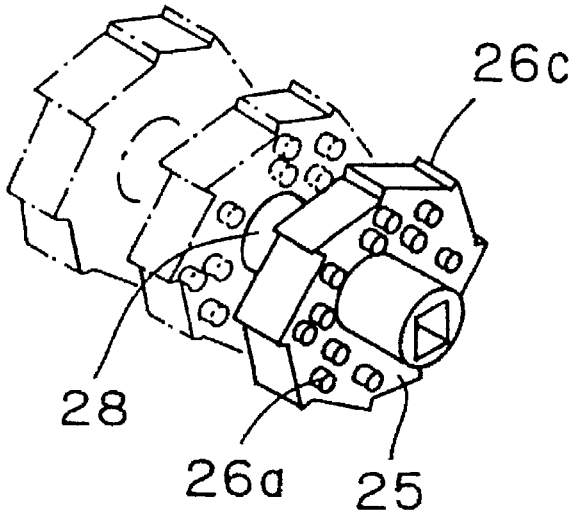

Even this waste screening machine 2 of the second embodiment can discharge lightweight objects such as radio cassette tapes, video cassette tapes, nylon cords, etc. by generating airflow toward the discharge side for the lightweight wastes W5 during operation and by floating such objects without causing winding. The machine can also discharge ropes and wire bundles which are difficult to rotate or slide by sequentially taking over such objects using the large diameter sections 25 and the projection stripes 26*b* thereof. In addition, the machine allows wet objects such as leftovers and sticky objects included in the wastes W to drop through the screening gaps G without causing clogging. By applying this capability, the machine can be used to screen bark, compost and farm products. When the rotation speed of the rotors 20 is increased, the screening gaps G defined between the projections 26*a* and the side surfaces of the large diameter sections 25 and between the projection stripes 26*b* and the peripheral surfaces of the small diameter sections 28 are narrowed relatively. When the speed is decreased, the screening gaps G are widened relatively. Furthermore, since the screens of the machine are formed by an arrangement of the rotors 20, the machine can have a simple structure which hardly causes clogging or breakage and facilitates installation. The machine can thus continuously screen a large amount of architectural wastes, home garbage, office trash, restaurant leftovers, etc. into five different wastes under a good operation condition of low noise and negligible vibration. It is needless to say that the rotor 20 can have an integrated roll structure having projections 26*a*' shown in FIG. 11(*a*) or projection stripes 26C shown in FIG. 11(*b*), or the same structure as that for the first embodiment.

The air pipe system 50 of this embodiment comprises a suction pipe 51 disposed over the lightweight waste discharge opening 43 of the horizontal section 40*b* of the housing 40, a cyclone separator 52 connected to the suction pipe 51 to separate the dust W0, a blower 53, the suction side of which being connected to the cyclone separator 52 via a pipe 54, an air discharge pipe 55 for supplying compressed air to the first and second nozzles 45, 46, and a blower motor 56, thereby forming a closed cycle.

Figure 12:
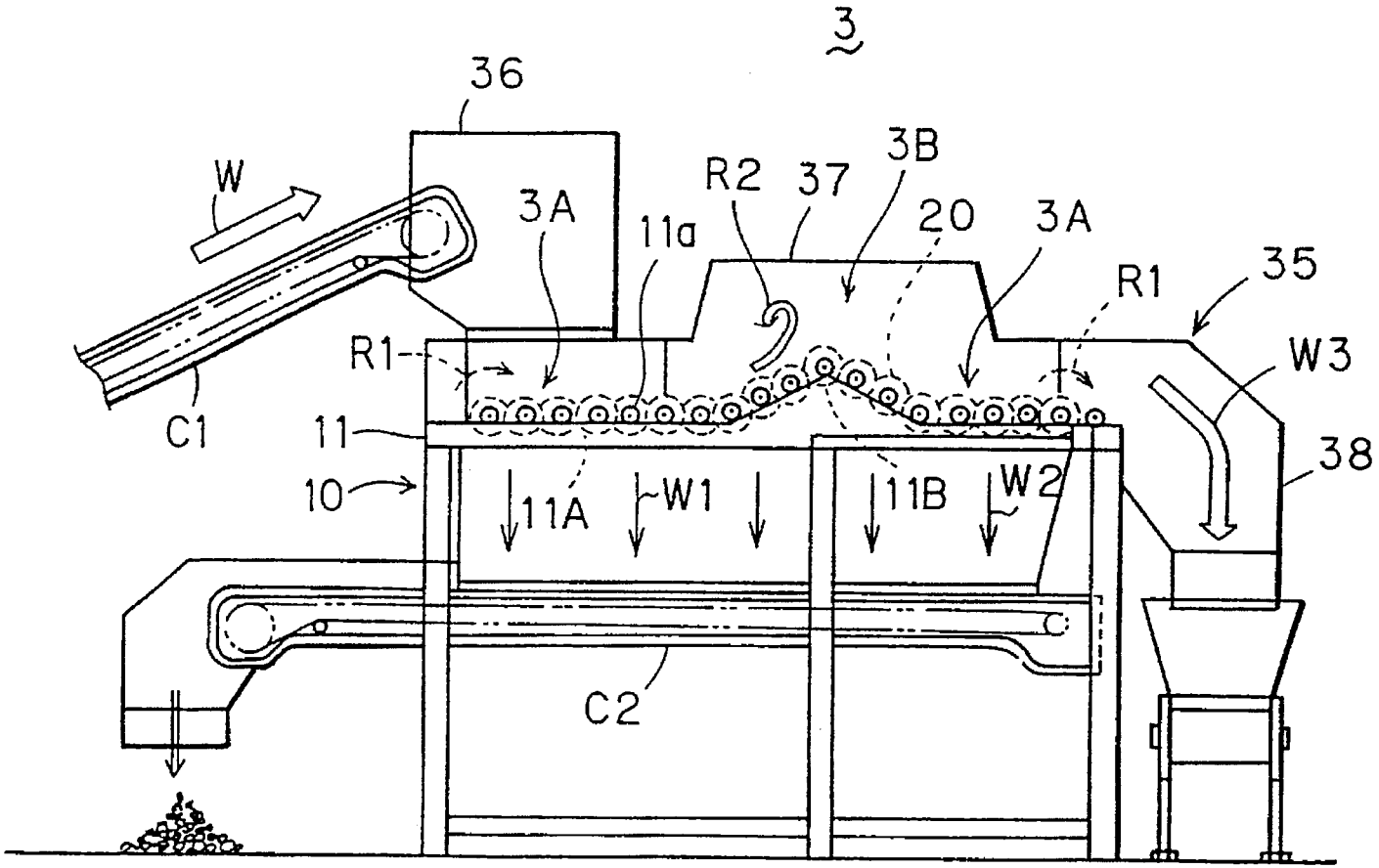
FIG. 12 is a front view of a waste screening machine of a third embodiment of the present invention.
Figure 13:
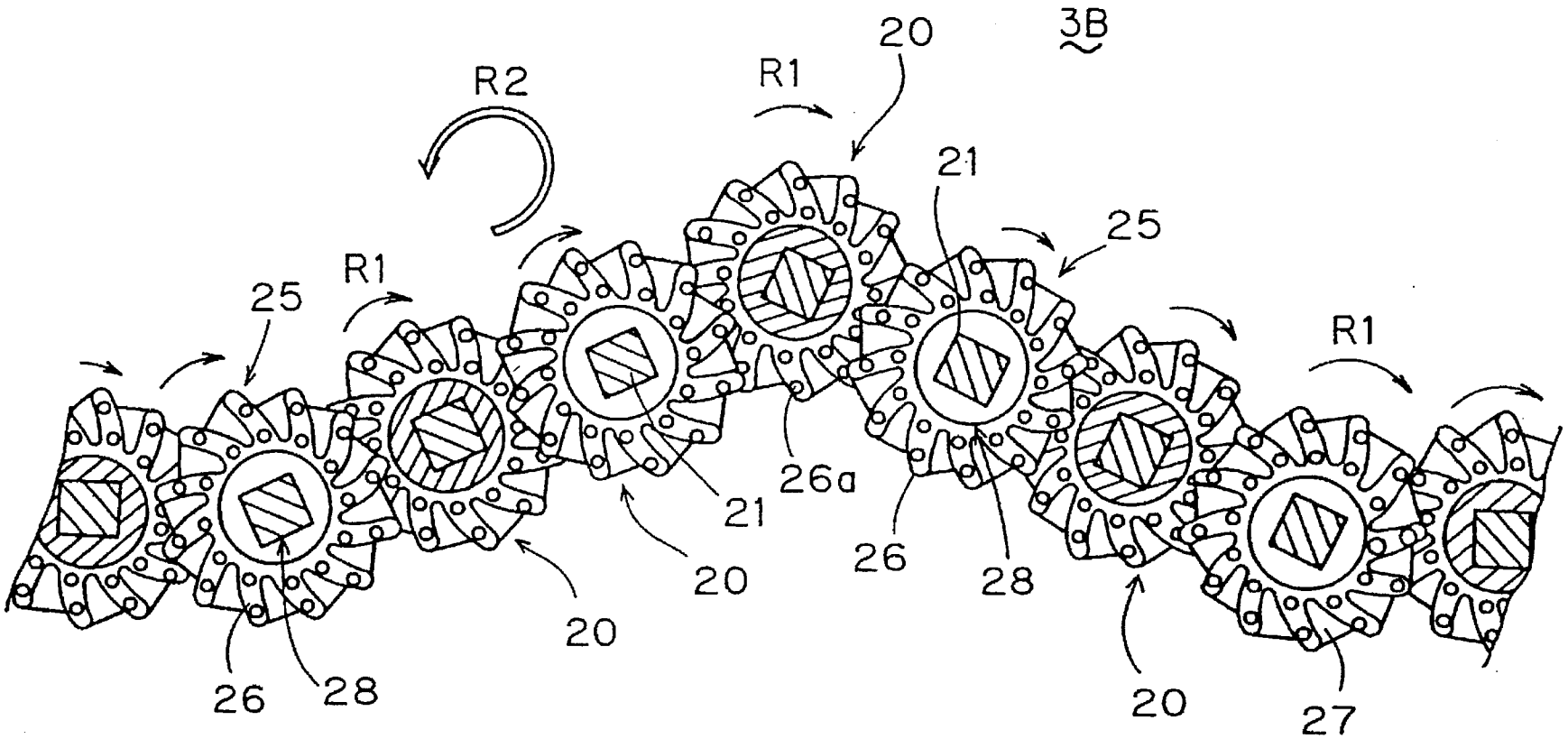
FIG. 13 is a partial vertical sectional view showing a raised area of the screening machine of the third embodiment.

Referring to FIGS. 12 and 13, the waste screening machine 3 of the third embodiment of the present invention is basically identical to that of the first embodiment, but it is characterized by a raised area 3B which is formed in the middle of the rotor arrangement to turn over objects to be screened and a housing 35 which is used to cover the upper section of the machine. The machine comprises a machine frame 10 installed over a belt conveyor C2 for transferring minute objects such as soil, small wastes W1 such as various broken pieces, and medium-sized wastes W2, a plurality of rotors 20 installed crosswise on longitudinal machine frame members 11 parallel and equidistant to one another in a nearly horizontal plane from the supply side where a conveyor C1 for supplying mixed wastes W is installed to the discharge side where large wastes W3 are discharged, journaled rotatably by a plurality of bearings 11*a* in the horizontal areas 3A, 3A on the supply and discharge sides of the machine, and five rotors 20 disposed in the raised area 3B angularly projecting upward at the middle section of the machine, a rotating drive means 30 for rotating all the rotors 20 arranged from the supply side to the discharge side in the same direction R1, and the housing 35. Each rotor 20 comprises large diameter wheels 25 having finger-shaped protrusions 26 connected by connection webs 27 and small diameter spacers 28, both the wheels and spacers being secured to a square shaft 21. However, the rotors used for the first and second embodiments can also be used.

The rotors 20 are rotatably journaled by the bearings 11*a* arranged over a horizontal frame section 11A in the horizontal area 3A and also rotatably journaled by the bearings 11*a* arranged at an angular frame section 11b in the raised area 3B. The rotating drive means 30 of this embodiment is identical to that of the first embodiment and rotates all the rotors 20 in the direction indicated by arrow R1. The housing 35 is fully opened at the bottom section thereof to allow small and medium-sized wastes W1, W2 to drop sequentially through the screening gaps between the rotors 20 from the supply side to the discharge side. The housing 35 comprises a supply section 36 having an opening for receiving mixed wastes W from a conveyor C2, a main section 37 raised at the middle section thereof, and a discharge section 38 having an opening for discharging large wastes W3. The housing 35 is used to prevent dust from lifting and can maintain airflow generated by the rotors 20 to transfer tapes or the like.

In the case of this embodiment, mixed wastes supplied over the horizontal area 3A of the rotor arrangement on the supply side are broken and scattered during transfer to the discharge side by the rotation of the rotors 20, . . . , and small and medium-sized wastes W1, W2 such as soil, broken pieces, drop through the screening gaps defined between the projections 26 adjacent in the feeding direction and between the ends of the projections 26 and the small diameter sections 28. In the raised area 3B, remaining lumps, piles, wet and damp objects and wastes remaining in bags and containers are turned over in the direction indicated by arrow R2 and retained for some time so that the lamps and piles are further broken and scattered, and substances attached to the large wastes W3 are separated and the wastes in bags and containers are scattered to enhance screening of the small and medium-sized wastes W1 and W2. Among mixed wastes W, heavy repulsive objects jump significantly and lightweight unrepulsive objects jump slightly while they are transferred sequentially by the rotors 20, . . . The wastes can therefore be broken and separated sufficiently and screened efficiently in large quantities. The screening capability and accuracy of the machine can thus be improved. In addition, the length of the machine can be made shorter than that of a machine which does not have the raised area 3B. Other features of this embodiment, such as the clogging prevention of the screening gaps, the changes in the relative dimensions of the screening gaps due to the difference in the rotation speed of the rotors and the generation of airflow for transferring tapes or the like are identical to those of the first embodiment and not explained herein. Furthermore, the number of the raised areas 3B can be changed appropriately depending on the scale of the screening machine 3 or the kinds of mixed wastes. In addition to the angular shape, the raised area 3B can have a trapezoidal shape.

Figure 14:
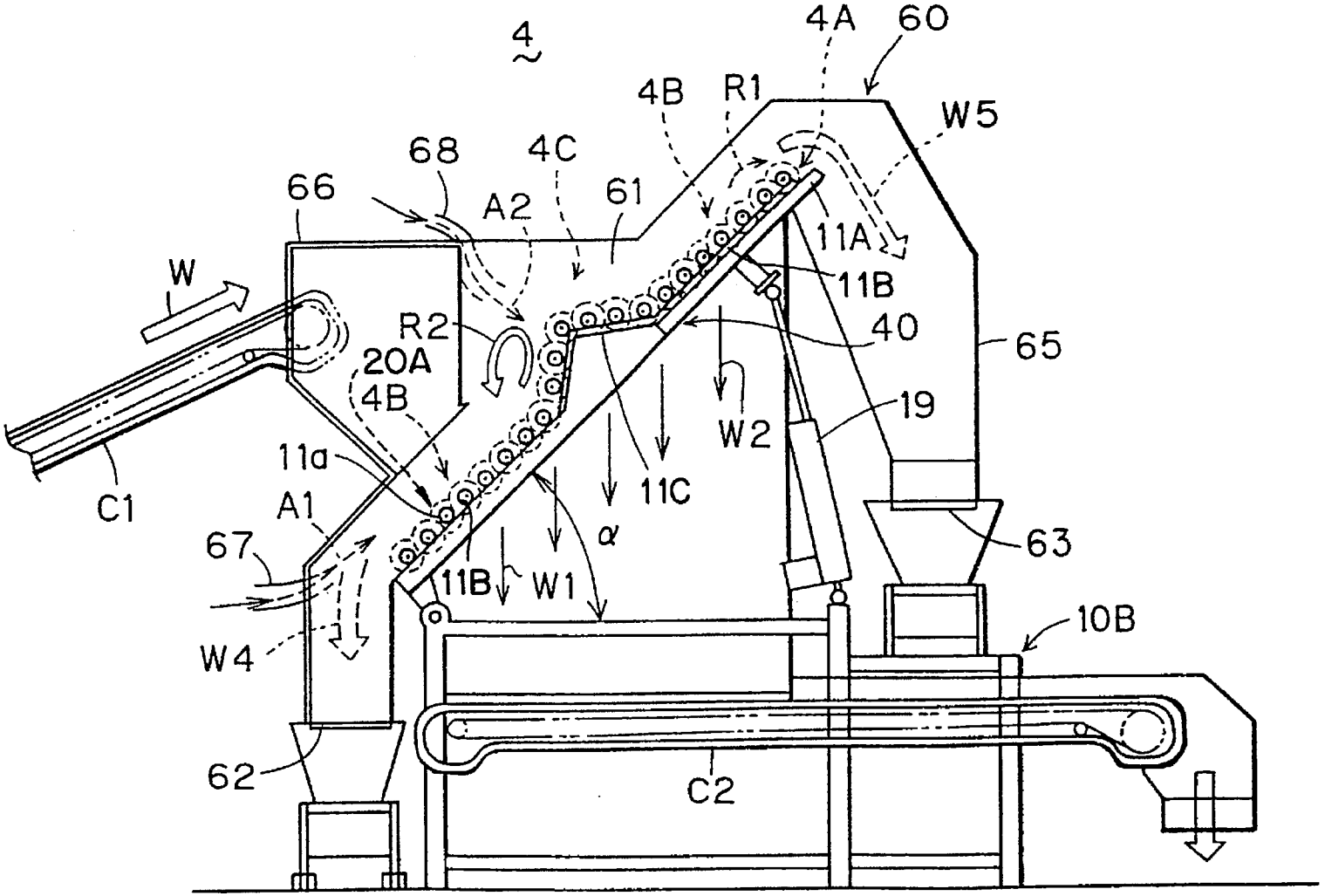
FIG. 14 is a front view of a waste screening machine of a fourth embodiment of the present invention.
Figure 15:
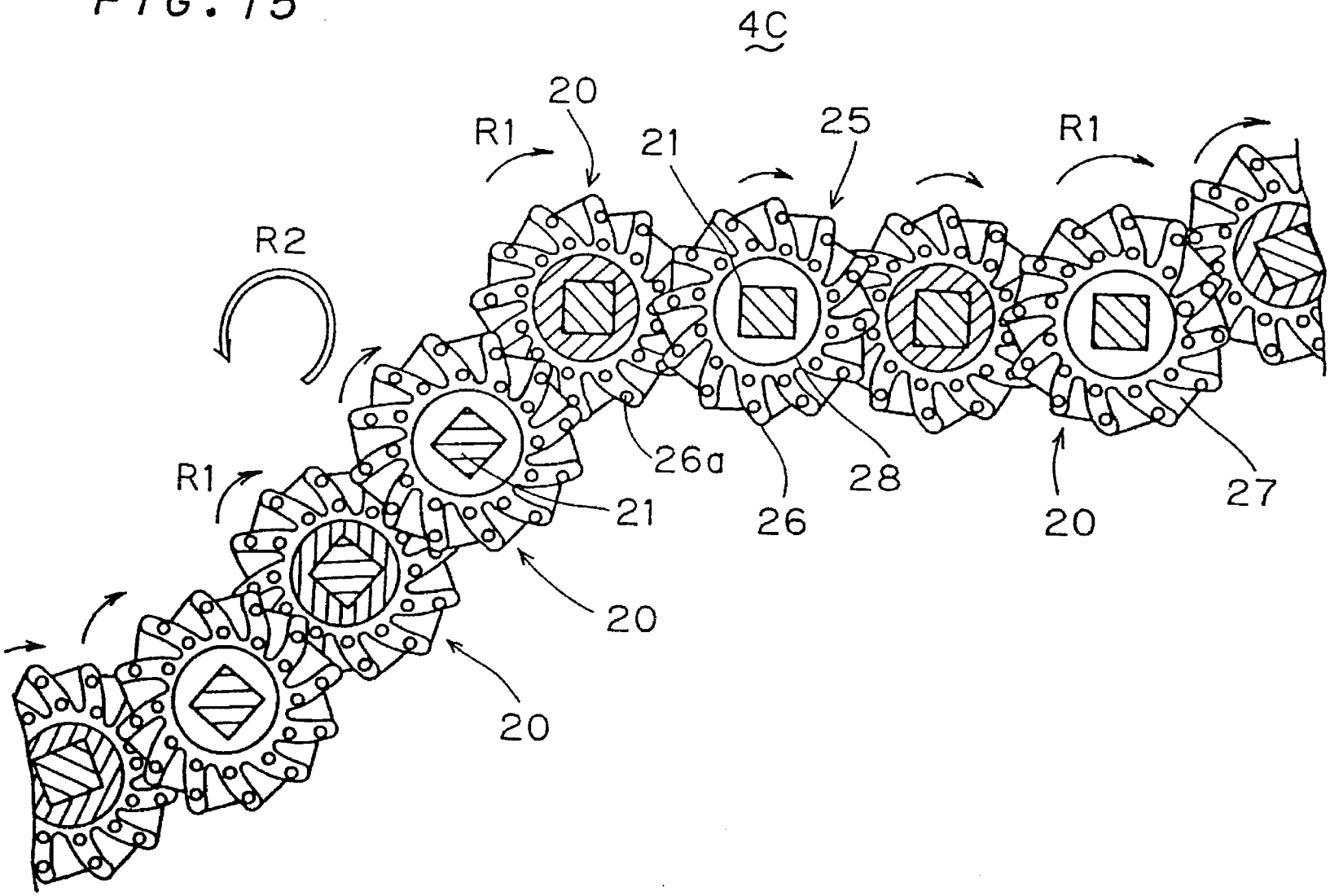
FIG. 15 is a partial vertical sectional view showing a raised area of the screening machine of the fourth embodiment.

Referring to FIGS. 14 and 15, the waste screening machine 4 of the fourth embodiment of the present invention is basically identical to that of the second embodiment, although this embodiment has no horizontal area. This embodiment is characterized by a raised area 4C formed in the middle of the inclined rotor arrangement to turn over objects to be screened. The screening machine 4 is used to screen wastes W including various wastes which have been broken roughly to appropriate sizes, supplied by a feed conveyor C1 and having differences in specific gravity and size into small and medium-sized wastes W1 and W2 such as soil, dust, metal particles, etc., heavy, easy-to-roll, repulsive wastes W4 such as stones, metal pieces, pet bottles, cans, glassware, etc. and lightweight, unrepulsive wastes W5 such as paper, film, sheets, cloth, corrugated cardboard, tapes, etc. The screening machine 4 comprises an inclined screening transferring block 4A wherein a plurality of rotors 20 rotatable in the direction indicated by arrow R1 to offer waste transferring force from the lower end to the upper end are arranged to form lower and upper rotor arrangement areas 4B, 4B having the same inclination and raised area 4C in the middle of the rotor arrangement, a machine base 10B for adjustably supporting the block 4A so that inclination angle $\alpha$ is adjustable via an extensible/retractable means 19, and a housing 60 opened at the bottom and covering both sides and the upper section of the block 4A to form a passage 61 over the block 4A. The housing 60 has an opening 62 for discharging repulsive, easy-to-roll, heavy objects at the lower end thereof, is connected to the upper end of a sub-housing 65 having an opening 63 for discharging unrepulsive difficult-to-roll lightweight objects, and has a hopper 66 for receiving mixed wastes W from a feed conveyor C1 in the middle section thereof. Furthermore, the passage 61 of the housing 60 is partially bent upward in accordance with the shape of the raised area 4C in the middle of the block 4A. Moreover, the housing 60 has, at its lower end, a first nozzle 67 for generating upward airflow A1 to assist transfer of lightweight wastes W5, particularly paper, tapes and cords. At its upper end, the housing 60 also has a second nozzle 68 for generating airflow A2 toward the raised area 4C to break piled and lumped books and to press such books against the raised area 4C in the middle of the passage 61. Since various rotors described in the explanations of the first and second embodiments may also be used for the rotors 20 of this embodiment, the explanation of the structure of the rotor is omitted herein. The rotating drive means of this embodiment For driving the rotors is basically identical to the above-mentioned rotating drive means.

The inclined frame 11A comprises inclined areas 11B, 11B having the same inclination angle on the supply and discharge sides and a raised bent area 11C. Over these areas, the rotors 20, . . . are journaled by bearings 11*a* together with the gear of the rotating drive means. In the case of this embodiment, mixed wastes W supplied to a basic inclined area 20A disposed at the lower section strike against the rotating rotors 20, . . . and they are broken. Repulsive, easy-to-roll, heavy objects B fall down to the discharge opening 62 while jumping on the rotors 20. Difficult-to-roll, unrepulsive, lightweight objects C are broken and scattered while jumping slightly during transfer by the rotation of the rotors 20, . . . As a result, small and medium-sized wastes W1, W2 such as soil, broken pieces, etc. drop through the screening gaps defined between the protrusions 26 adjacent in the feeding direction and between the ends of the protrusions 26 and the small diameter sections 28. At the raised area 4C, remaining lumps, piles, attached substances and wastes remaining in bags and containers are turned over in the direction indicated by arrow R2 so that the lumps and piles are further broken and scattered and the wastes in bags and containers are scattered to enhance screening of small and medium-sized wastes W1, W2. Mixed wastes W are dropped downward or transferred upward sequentially by the rotors 20, . . . The wastes can therefore screened continuously and efficiently in large quantities. The screening capability and accuracy of the machine can thus be improved. In addition, the length of the machine can be made shorter than that of the machine which has no raised area.

Lightweight objects such as radio cassette tapes, video cassette tapes, nylon cords, etc. can be floated and discharged from the opening 63 without causing winding by using upward airflow generated over the rotors 20 during operation by the protrusions 26 on the rotating rotors 20, the projections 26*a*, 26*a* disposed on the sides of the large diameter sections of the rotors 20 and the projection stripes disposed at the peripheries of the large diameter sections of the rotors 20 and by using additional airflow A1 generated from the nozzle 67. Slightly heavier cords and rope bundles can also be taken over sequentially by the finger-shaped protrusions 26 and their projections 26*a* and then discharged via the upper end, while the connection webs 27 disposed between the protrusions 26 serve to prevent such objects from winding around the protrusions 26. Even if wet objects such as leftovers or compost are included in the wastes W, they can be dropped downward without causing clogging, since new screening gaps G are formed successively by the rotating protrusions 26 and projections 26*a*. By applying this capability, compost can be screened. Besides, the machine hardly causes clogging and breakage, and has a structure facilitating installation and maintenance. The machine can continuously screen a large quantity of architectural wastes, household garbage, office trash, restaurant leftovers, etc. into four different sizes. In addition to the screening of the above-mentioned architectural wastes, household garbage, etc. the screening machine 4 can separate magazines and newspapers from vinyl cords and sheets which were used to bundle such magazines and newspapers, and the machine is suited for shaking off soil and foreign matters from magazines and newspapers. In this case, the machine screens magazines and newspapers as heavy wastes W4, cords and sheets as lightweight wastes W5, and soil and foreign matters as small wastes W1. In particular, in the raised area 4C, cords and sheets caught between piled books and newspapers can be separated while such books and newspapers are turned over. The inclination angle $\alpha$ and the rotating speed of the rotors 20 have been set so that magazines and newspapers can slip down over the rotors 20. Other than the structure wherein a plurality of rotors 20 are protruded in a raised angular shape, a structure wherein a plurality of rotors 20 are arranged in a trapezoidal shape can also be used in the raised area 4C. In the case of this structure, when the rotating speed is increased, transfer operation becomes more effective than retaining operation during turnover. Furthermore, both the angular and trapezoidal shapes can be used together.

Figure 16:
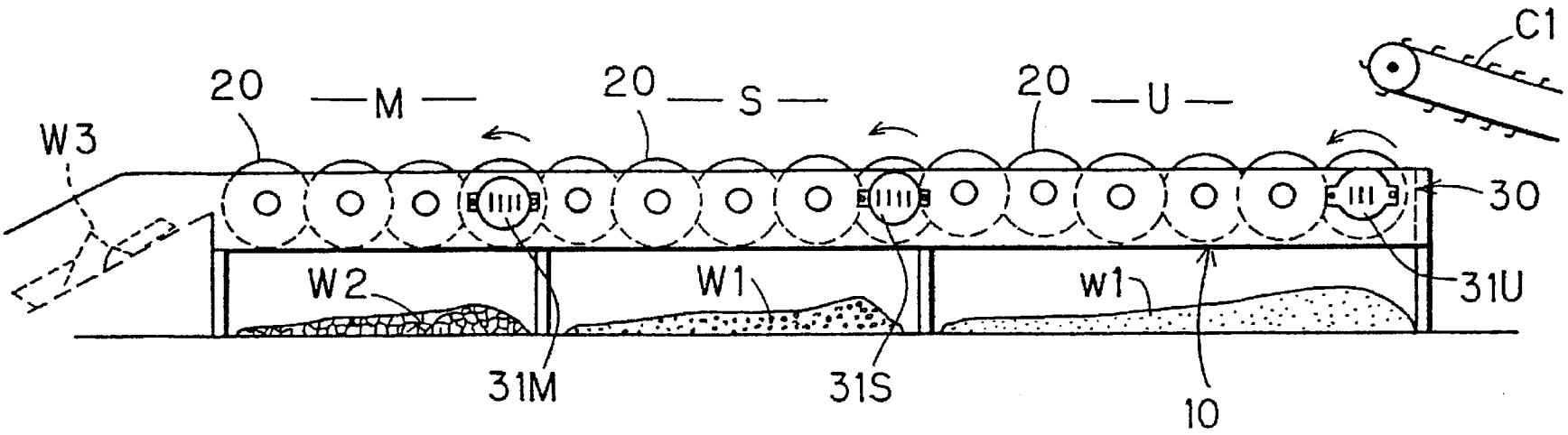
FIG. 16 is a front view of a screening machine of a typical embodiment of the present invention with the rotors grouped depending on the rotation speeds thereof.

The above-mentioned screening machines 1 to 4 of the first to fourth embodiments can be modified further as described below. By applying the fact that the screening gaps are widened relatively when the rotating speed of the rotors 20 is decreased, a plurality of rotors 20 arranged on a longer machine base 10 are classified into three groups for example as shown in FIG. 16. The rotating speeds of the rotors 20 of the three groups are decreased sequentially in the feeding direction from the supply side to the discharge side so that small and medium-sized wastes W1, W2 discharged by the machine of the first embodiment are further screened sequentially into minute wastes w1, small wastes W1 and medium-sized wastes W2. In this case, although the structure of the rotors 20, . . . , the dimensions of the screening gaps G and the structure of the rotating drive means 30 are common for all the three groups: a minute object screening group U, a small object screening group S and a medium-sized object screening group M, only the rotating speeds of the inverter motors 31U, 31S and 31M corresponding to the three groups respectively are decreased sequentially.

Figure 17:
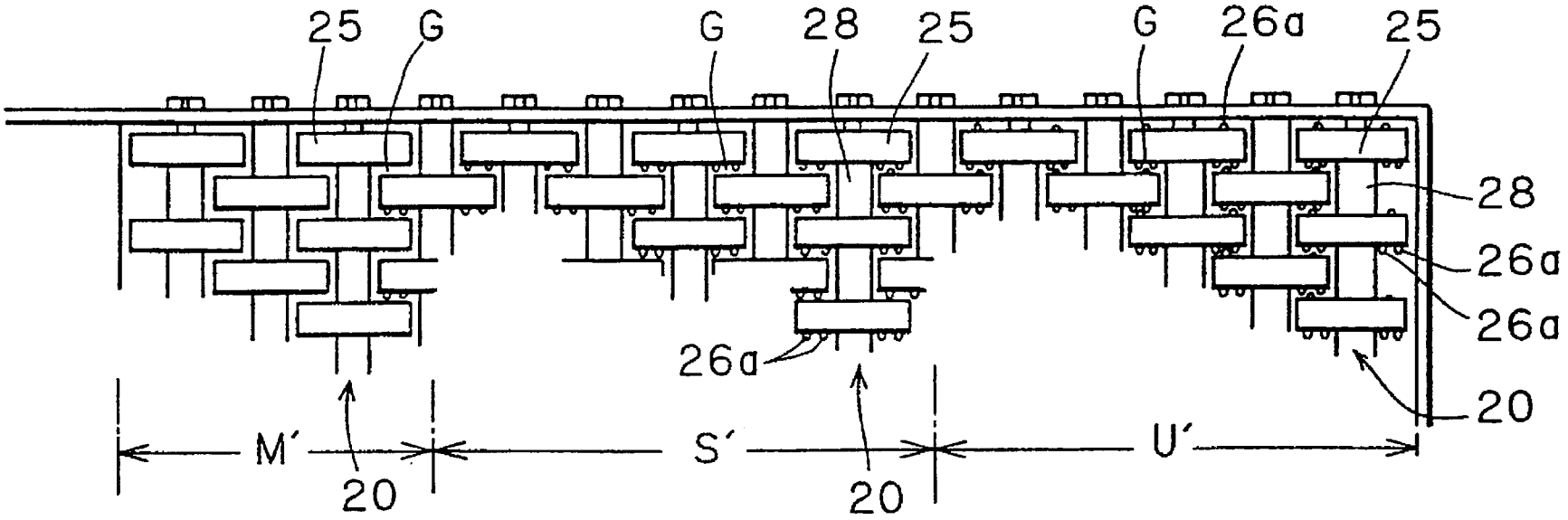
FIG. 17 is a plan view of a screening machine of an application example with the rotors grouped depending on the dimensions of screening gaps.
Figure 18:
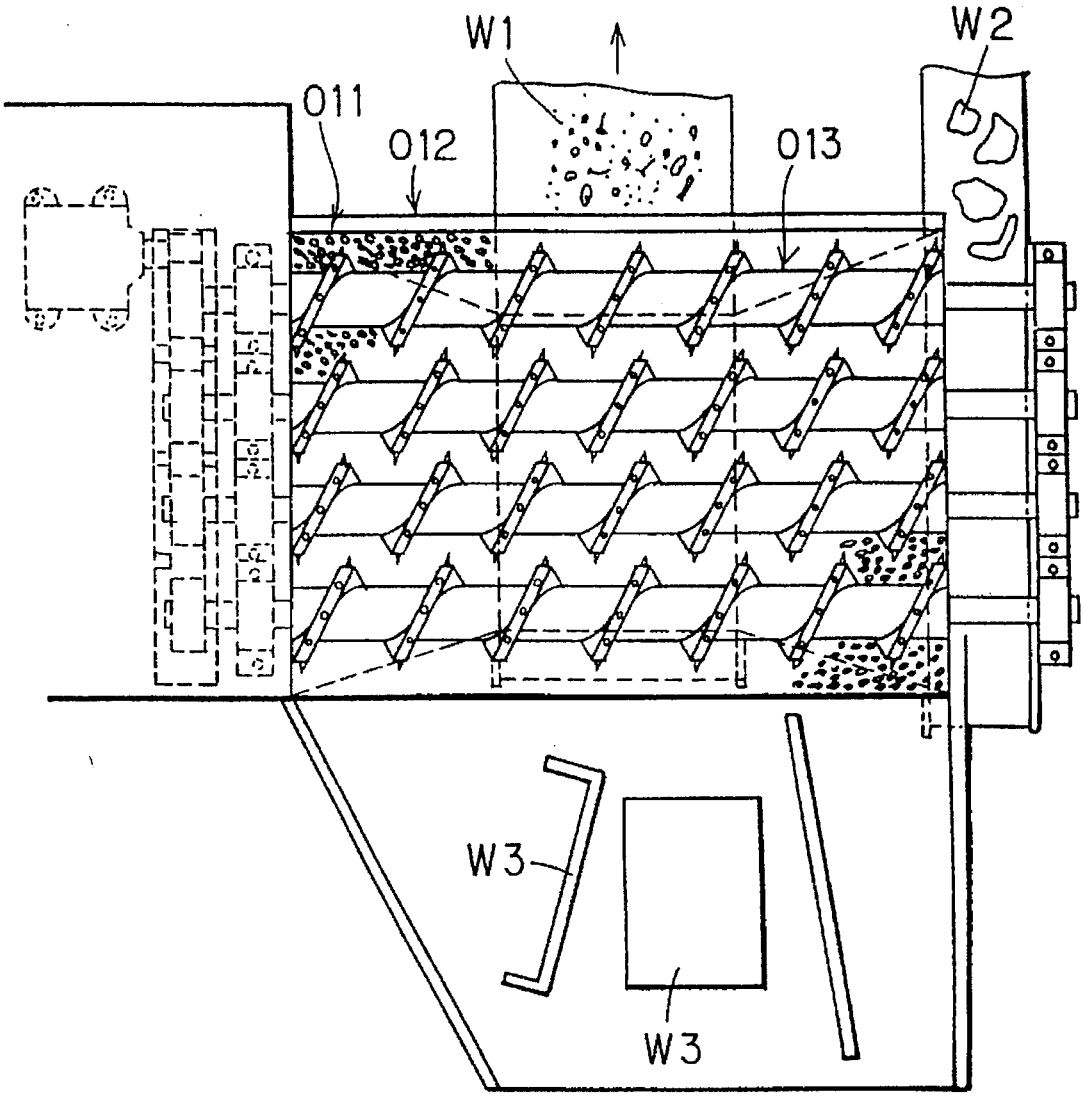
FIG. 18 (PRIOR ART)
FIG. 18 is a plan view of a conventional waste screening machine.

As another application example, the dimensions of the screening gaps G between adjacent wheels 25, 25 can be changed depending on the presence or absence of the projections 26*a* on the sides of the large diameter section 25 as shown in FIG. 17. In other words, a plurality of rotors 20, . . . arranged on a longer machine base is classified into three groups: a minute object screening group U', a small object screening group S' and a medium-sized object screening group M'. In the minute object screening group U', one projection 26*a* is disposed for each row of radial protrusions on one side of each large diameter wheel 25 and two projections 26*a*, 26*a* are disposed for each row of radial protrusions on the other side of each large diameter wheel 25 so that the one projection 26*a* on one side of a wheel 25 passes through the space between the two projections 26*a*, 26*a* on one side of another wheel 25 adjacent to the former wheel 25. In the small object screening group S', one side of each wheel 25 is made flat and two projections 26*a*, 26*a* are disposed for each row of radial protrusions on the other side so that the dimensions of the screening gaps G are made slightly larger than those for the above-mentioned group U'. In the medium-sized object screening group M', both sides of each wheel 25 are made flat to further widen the screening gaps G. Although this application example uses the large diameter wheels of the same size, the dimensions of the screening gaps G can be changed by changing the size of the large diameter wheels 25 and the width of the small diameter spacers 28 as a matter of course. To reduce production cost, the number of spare parts items and the quantities of spare parts, it is a good idea to use the large diameter wheels 25 and the small diameter wheels 28 having standard dimensions and to make the projections 26*a* removable. Both the application examples described above are also applicable to the inclined-type screening machines 2 and 4.

In addition to the method of changing the actual dimensions of the screening gaps G, the method of changing the relative dimensions of the screening gaps G by changing the rotating speed of the rotors as described in the above-mentioned application example can also be used. Furthermore, lightweight objects such as paper, plastic film, etc. can be screened by generating airflow upward from under the rotors using an air blowing means and a suction hood disposed over the rotors. Moreover, large objects to be discharged to the discharge side can be screened into lightweight and heavy objects depending on the difference in specific gravity by using centrifugal force generated by increasing the peripheral speed of at least one rotor of the last row. Besides, another drive means can be used to reversely rotate one or two rotors disposed at the middle section to provide an area for retaining objects to be screened, or to increase the speed of one or two rotors higher than those of any other majority rotors so that the machine is additionally capable of breaking lumps and piles.

It is needless to say that the screening machines 1 to 4 of the embodiments 1 to 4 of the present invention can be used to screen not only wastes but also various particles, lumps, compost, etc.

I claim:

1. A separating machine comprising a plurality of rotors (20) provided in a frame (10) such that axes of said rotors are arranged parallel to one another from a supply side where objects to be screened (W) including mixed substances different at least in size are supplied from above by a conveying means (C1) to a discharge side where the remainders after screening are discharged, a series of rotors (20) being arranged in an inclined plane with a series of said rotors (20) on the discharge side being placed partially higher than those on the supply side and the inclined plane having at least one raised area (4C) provided between said discharge and supply sides, and such that said rotors (20) are rotated in the same direction by a rotating drive means (30) to feed the objects to be screened from the supply side to the discharge side, and each rotor (20) further comprises a plurality of large diameter sections (25) and a plurality of small diameter sections (28) alternately disposed in the axial direction of each rotor (20) and arranged in a staggered relation in the feeding direction to define screening gaps (G) having desired dimensions between said large and small diameter sections (25–28), and each of said large diameter sections (25) of said rotor (20) has a plurality of projections (26*a*) at least on one side, which do not interfere with said large diameter sections (25) and said small diameter sections (28) of adjacent rotors (20).

2. A separating machine according to claim 1, wherein said large diameter section (25) of said rotor (20) is formed by a wheel having a plurality of finger-shaped protrusions (26) which are curved backward in the rotor rotation direction and connected by connection webs (27) in the peripheral direction of said large diameter section (25), and said small diameter section (28) is formed by a small diameter wheel.

3. A seperating machine according to claim 1, wherein said large diameter section (25) and said small diameter section (28) of said rotor (20) are discs having a circular or polygonal shape.

4. A separating machine according to claim 1, wherein said rotor (20) comprises said large diameter sections (25) and said small diameter sections (28) arranged alternately and integrated.

5. A separating machine according to claim 1, wherein said plurality of said rotors (20) are classified into several groups arranged from the supply side to the discharge side, and the peripheral speeds of said rotors of the groups are decreased in order of the classified arrangement from the supply side to the discharge side.

6. A separating machine according to claim 1, wherein said plurality of said rotors (20) are classified into several groups from the supply side to the discharge side and the gaps between the adjacent large diameter sections (25)-(25) of each group are decreased in order of the classified arrangement from the supply side to the discharge side.

7. A separating machine according to claim 1, wherein air blowing means (45, 46) are provided above said plurality of said rotors (20) to generate an upward air flow.

8. A separating machine according to claim 5, wherein the rotational speed of at least one rotor (20) of the last row of said plurality of said rotors (20) is increased to sort the remainders into heavy objects, and light weight objects by allowing such heavy and light objects to drop at a distant dropping area and at a near dropping area respectively by virtue of centrifugal force.

9. A separating machine according to claim 1, wherein said plurality of said rotors (20) constitute an inclined screening transfer block (2B) and a horizontal screening transfer block (2C) over the upper end of said inclined block (2B), said block (2C) having a structure nearly identical to that of said inclined block (2B) so as to screen relatively large particles by allowing them to drop from the screening gaps (G) of said blocks, and the inclination angle of said inclined screening transfer block (2B) can be adjusted by an extensible/retractable means (19).

10. A screening machine according to claim 1, wherein said plurality of said rotors (20) constitute an inclined screening transfer block (2B), said block (2B) is covered, except for the bottom section thereof, by a housing (85) having an opening (62) at the lower end section thereof for allowing repulsive objects and easy-to-roll heavy objects to drop, having an object supply opening (61) at the upper intermediate section thereof and having an opening (63) at the upper end section thereof for allowing unrepulsive objects, difficult-to-roll objects and lightweight objects to drop, and an air blowing means (45) for generating airflow obliquely upward is disposed at the lower end section of said housing (35).

11. A separating machine according to claim 1, wherein said plurality of said rotors (20) constitute an inclined screening transfer block (2B), said block (2B) is covered, except for the bottom section thereof, by a housing (35) having an opening (62) at the lower end section thereof for allowing repulsive objects and easy-to-roll heavy objects to drop, having an object supply opening (61) at the upper intermediate section thereof and having an opening (63) at the upper end section thereof for allowing unrepulsive objects, difficult-to-roll lightweight objects to drop, and an air blowing means (45) for generating airflow obliquely upward is disposed at the lower end section of said housing (35).

12. A separating machine according to claim 6, wherein the rotation speed of at least one rotor (20) of the last row of said plurality of said rotors (20) is increased to sort the remainders into heavy objects and lightweight objects by allowing such heavy and lightweight objects to drop at a distant dropping zone and at a near dropping zone respectively by virtue of centrifugal force.

* * * * *